United States Patent [19]

Franklin et al.

[11] 4,019,831

[45] Apr. 26, 1977

[54] COOLED ROTOR BLADE FOR A GAS TURBINE

[75] Inventors: Clifford John Franklin, Winterthur; Hans Melliger, Wil, both of Switzerland

[73] Assignee: Brown Boveri Sulzer Turbomachinery Ltd., Zurich, Switzerland

[22] Filed: Aug. 28, 1975

[21] Appl. No.: 608,754

[30] Foreign Application Priority Data

Sept. 5, 1974 Switzerland ..... 12079/74

[52] U.S. Cl. ..... 416/97 R; 416/96 A

[51] Int. Cl.[2] ..... F01D 5/18

[58] Field of Search ..... 416/97, 95, 96 A, 96; 415/115, 116

[56] References Cited

UNITED STATES PATENTS

| | | | |
|---|---|---|---|
| 2,647,368 | 8/1953 | Triebbnigg et al. | 416/97 |
| 2,650,803 | 9/1953 | Rosskopf | 416/96 A |
| 2,873,944 | 2/1959 | Wiese et al. | 416/96 A |
| 2,920,866 | 1/1960 | Spurrier | 416/96 A |
| 3,369,792 | 2/1968 | Kraimer et al. | 416/97 X |
| 3,373,970 | 3/1968 | Brockmann | 416/96 A |
| 3,574,481 | 4/1971 | Pyne et al. | 416/97 X |
| 3,635,587 | 1/1972 | Giesman et al. | 416/97 |
| 3,707,750 | 1/1973 | Klass | 416/97 |
| 3,807,892 | 4/1974 | Frei et al. | 416/97 X |
| 3,846,041 | 11/1974 | Albani | 416/97 |
| 3,867,068 | 2/1975 | Corsmeier et al. | 416/97 |
| 3,902,820 | 9/1975 | Amos | 416/97 |

FOREIGN PATENTS OR APPLICATIONS

| | | | |
|---|---|---|---|
| 949,016 | 9/1956 | Germany | 416/96 A |
| 167,979 | 8/1959 | Sweden | 416/97 |
| 833,770 | 4/1960 | United Kingdom | 416/96 A |

*Primary Examiner*—Everette A. Powell, Jr.
*Attorney, Agent, or Firm*—Kenyon & Kenyon Reilly Carr & Chapin

[57] ABSTRACT

The hollow interior of the blade is lined with a hollow insert and ribs to define a plurality of flow passages of narrow cross-section which connect a cooling-air chamber in the blade root with a cooling-air chamber in the blade tip. The chamber in the blade tip communicates with the interior of the insert and orifices are formed in the insert to exhaust air via a perforated partition through the trailing edge of the blade. The hollow insert is anchored in the blade root in various manners.

11 Claims, 9 Drawing Figures

COOLED ROTOR BLADE FOR A GAS TURBINE

This invention relates to a cooled rotor blade for a gas turbine.

In the endeavour to ensure minimal thermal stressings in gas turbine blades, blade constructions must be made with as few as possible sharp and/or abrupt changes in wall thicknesses over the blade cross-section. In addition, since relatively high cooling-air speeds which produce turbulent flows are required for satisfactory heat exchange, particularly where available quantities of cooling air are reduced, the cooling-air passages usually require relatively narrow cross-sections. Also, to ensure that the available cooling air is distributed to the various regions of the blade in accordance with a required pattern, the cross-sections of the individual cooling-air passages or ducts or channels must be defined very accurately. However, on occasion it has been difficult to meet all these requirements, particularly in the case of blades of relatively thick cross-section.

Accordingly, it is an object of the invention to provide a blade for a gas turbine which is subject to minimal thermal stressing.

It is another object of the invention to reduce the thermal stressing of a turbine blade in a relatively simple manner.

It is another object of the invention to provide for a relatively efficient pattern of high velocity cooling air flow in a gas turbine blade.

Briefly, the invention provides a rotor blade for a gas turbine which comprises a hollow jacket or casing and at least one insert within the jacket which serves to form a plurality of narrow flow passages within the blade over a substantial portion of the blade interior without need of abrupt changes in wall thicknesses.

The hollow jacket defines a blade root, a blade tip, a trailing edge and an elongated hollow chamber extending longitudinally between the blade root and blade tip. The insert is within this hollow chamber and extends from the blade root to the blade tip. In addition, a cooling-air chamber is formed in the blade root to receive cooling air and a second cooling-air chamber is formed in the blade tip in communication with the interior of the insert. Also, a plurality of flow passages extend from the cooling-air chamber in the blade root to the cooling-air chamber in the blade tip between the insert and the jacket. These passages are formed by ribs on the jacket within the hollow chamber which are disposed against the insert and which extend from blade root to blade tip.

The hollow chamber of the rotor blade is further defined by a perforated partition against which the insert rests. The insert also has orifices which communicate the interior of the insert via the perforated partition with the trailing edge of the blade. In this way, cooling air can be exhausted from within the insert through and over the length of the trailing edge via outlets in the trailing edge.

In operation, cooling air passes into the cooling chamber in the blade root, flows through the narrow flow passages between the insert and jacket into the cooling chamber in the blade tip and then passes into the interior of the insert. The cooling air then exits via the orifices in the insert and perforated partition into and across the trailing edge and from there passes from the blade via the outlets in the trailing edge.

The blade also includes a means within the blade root for anchoring the insert within the hollow chamber.

The insert can either be a rigid device which is fitted into the hollow space e.g. by pressing, or can be a resilient device which can be resiliently deformed, then introduced into the hollow interior from the blade tip, and then pressed against the ribs.

The blade construction allows a means of producing the considerable degree of uniformity — and, if necessary, providing a gradual and continuous variation — in the wall thicknesses determined by the required mechanical properties of the blade. The flow passages, which can, for example be either cast in with the jacket or subsequently milled in the casting, are distributed substantially uniformly over the wide periphery of the blade jacket or casing. Due to the presence of the insert which at least substantially extends to and contacts the ribs, the flow passages also have a defined total cross-section and definite individual cross-sections which can vary in accordance with the quantities of cooling air required in the discrete passages. For instance, the passage in the leading edge, i.e. the blade nose, where cooling must be relatively intensive, is of larger cross-section than the other passages. The arrangement and cross-section of the various passages therefore ensure a particular cooling-air distribution over the blade periphery. Also, despite the thickness of blade cross-section, the total passage cross-section is relatively small, so that flow speeds sufficient for satisfactory heat exchange can be produced in the passages with relatively small amounts of cooling air. There is also virtually no pressure drop of the cooling air in the hollow interior of the blade, and so the pressure gradient still available in the cooling-air chamber in the blade tip is fully available to cool the trailing edge of the blade.

In one embodiment, the blade has the hollow interior of the outer jacket widening continuously from the blade root to the blade tip. In this embodiment, it may be advantageous if a thin sheet-metal insert is used which has the same peripheral length over the whole length of the blade, and which has the insert ends near the trailing or rear edge of the blade bent in with the bent-in length of the insert increasing continuously from the blade tip. With this feature, the sheet-metal periphery of the insert remains constant over the whole length of the blade at least outside the blade root. Thus, the stresses arising in the insert can be relatively reduced. Also, the insert can be made out of conical sheet metal with the wall thickness decreasing at the tip, as a means of reducing stressing still further. Conveniently, to obviate an abrupt edge in the insert, particularly near where the insert is anchored in the blade root, a spacer element of a thickness corresponding to approximately 1 ½ times the thickness of the metal insert is introduced between the bent-in parts of one side of the insert near the region where the same is anchored in the blade root.

The centrifugal forces experienced by a rotor make reliable and secure fixing of the insert in the blade root of considerable importance. Thus, the means for anchoring the insert may include, for instance where the insert is thin walled and is anchored in a corresponding recess in the blade root, a wedge-shaped pin or the like between double layers of the insert. Another means which is simple to produce and assemble has the thin sheet metal insert rigidly connected to a retaining member at the end near the blade root while the retaining member is received in a recess in the blade root and retained in such recesses by pins, which are introduced into recesses extending to some extent in the side walls of the latter recess and to some extent in the side walls of the retaining member. In this case, the pin can be provided with a means for securing the pin against displacement relative to the blade root, e.g. by welding or staking.

As a third possibility for providing a secure anchorage, the thin sheet metal insert is rigidly connected, at the end near the blade root, to a retaining member formed at an opposite end with a hollow space closed in pressure-tight manner by a second deformable and hood-like sheet-metal member. This latter hollow space communicates via a passage in the retaining member with the hollow interior of the insert. In this case, the hollow space in the retaining member can be at least partly filled with a brazable substance. Apart from the anchoring of the insert to the retaining member, the various types of anchoring means between the insert and the blade root are purely mechanical and are therefore very suitable in cases where it is difficult or impossible for the insert to be secured in the blade root by welding or brazing.

To further improve heat exchange with the cooling air, cross-ribs are provided between the longitudinal ribs which bound to the flow passages.

These and other objects and advantages of the invention will become more apparent from the following detailed description and appended claims taken in conjunction with the accompanying drawings in which:

FIG. 1 illustrates a longitudinal sectional view taken on line I—I of FIGS. 2 and 4 of a blade according to the invention;

FIG. 1*a* illustrates a detail of FIG. 1 to an enlarged scale;

Figures 1, 1A:
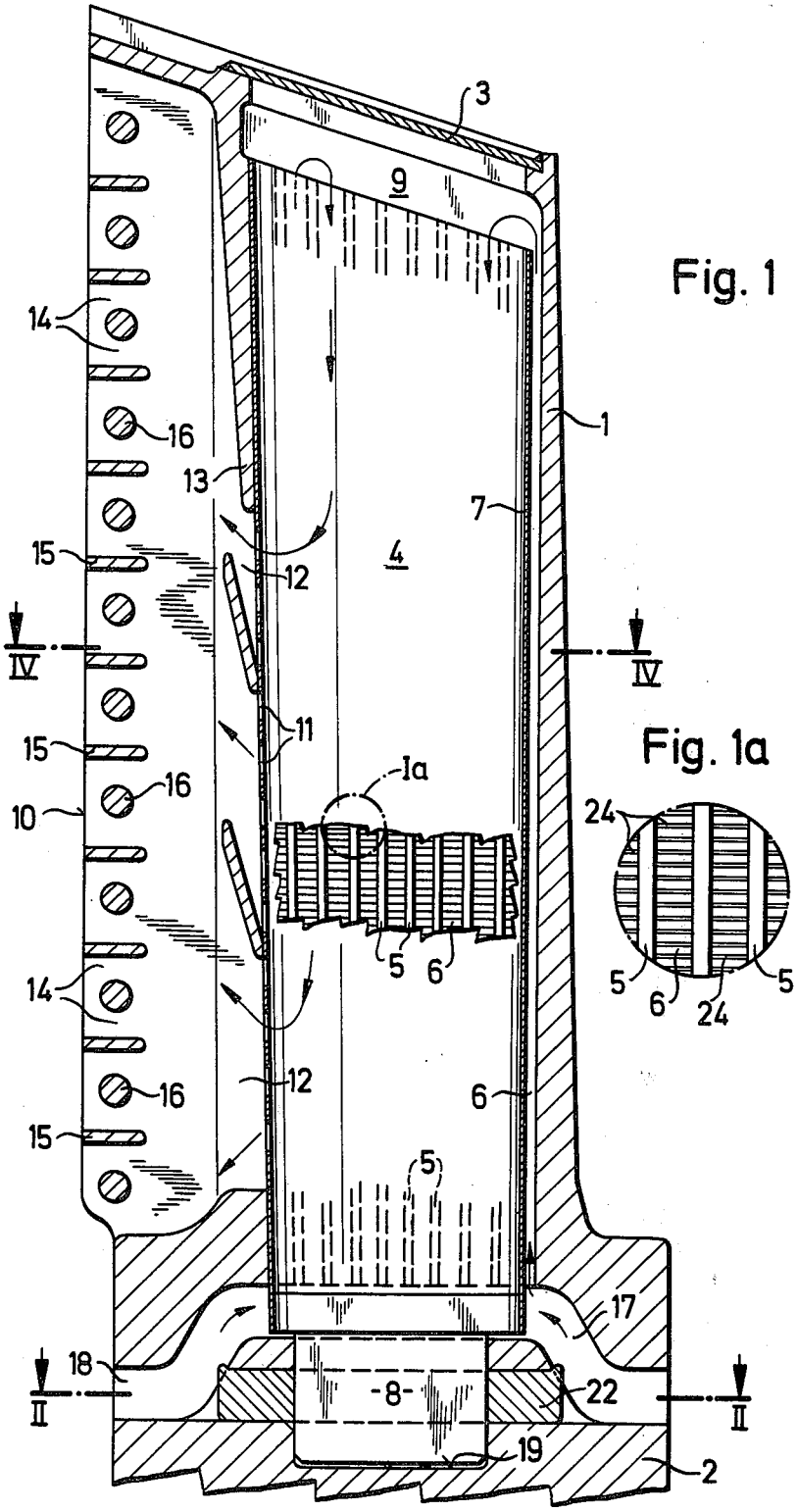
Figure 2:
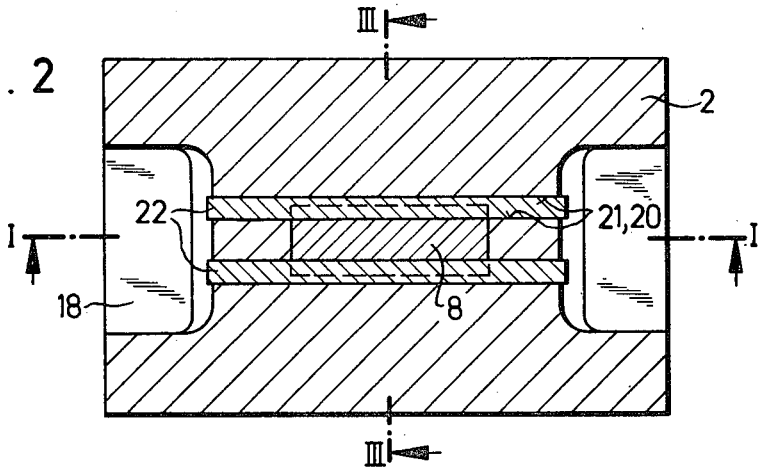
FIG. 2 illustrates a view taken on line II—II of FIG. 1.

Referring to FIG. 1, a cooled rotor blade for a gas turbine includes a hollow outer envelope or jacket 1 whose wall thickness is conical and which merges at the hub end into a blade root 2 and which is closed at the blade tip be a brazedin cover 3. The jacket 1 further defines a leading edge, a trailing edge 10, a perforated partition 13 and a hollow chamber 4 on one side of the partition. The jacket has a plurality of ribs 5 on an inner wall which extend from the blade root to the blade tip to bound flow passages 6 for cooling air. The passages 6, which can have narrow cross-ribs 24, visible in FIG. 1*a*, to improve the cooling action, extend from a cooling-air chamber 17 in the blade root 2 and terminate in a cooling-air chamber 9 in the blade tip 3. This latter chamber 9 is formed by a widening of the jacket 1.

The passages 6 are sealed off from hollow chamber 4 of the jacket 1 by a thin-walled resilient metal insert 7, which as shown in FIGS. 1 to 4, is rigidly secured, e.g. by brazing, at the hub end to a retaining member 8. This insert 7 is open near the blade tip and terminates in the chamber 9 so that the chamber 9 provides a flow connection between the passages 6 and the interior of the insert 7. In the part near the blade trailing or rear edge 10, the insert 7 is formed with orifices 11 which cooperate with corresponding orifices 12 in the partition 13 and which extend to air outlets 14 extending over the length of the blade near the trailing edge 10. Webs 15 and baffles 16 are disposed in the outlets 14 to uniformise air distribution.

The blade is also provided with a feed passage 18 extending transversely of the root 2 to supply cooling air to the chamber 17.

Consequently, the cooling air which enters the blade through passage 18 goes first from chamber 17 in through the passages 6 towards the blade tip, leaves the passages 6 through the chamber 9 at the end thereof and enters the interior of the insert 7, and leaves the insert interior through the orifices 11 and 12 and is exhausted through the outlets 14 in the blade trailing edge 10.

Figure 3:
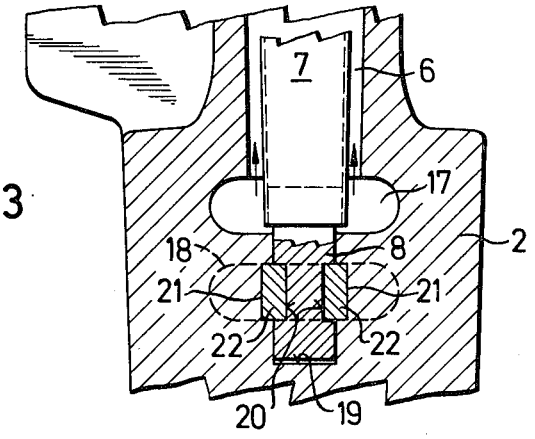
FIG. 3 illustrates a view taken on line III—III of FIG. 2.
Figure 4:
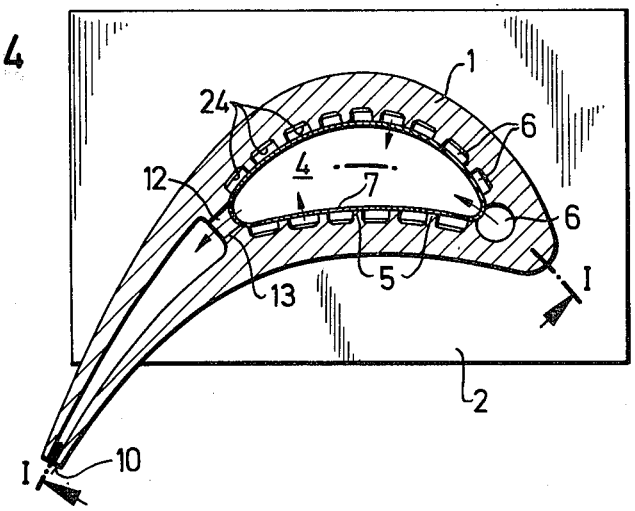
FIG. 4 illustrates a view taken on line IV—IV of FIG. 1.

As shown in FIG. 1, the retaining member 8 is received in a recess 19 in the blade root 2 and is formed on both side walls with rectangular recesses 20 which are continued lengthwise of the blade root 2 (FIG. 2) and which are also present, but in laterally inverted form, in the blade root 2. Consequently, and as can be seen in FIG. 3, spaces 21 which are disposed to some extent in root 2 and to some extent in member 8 arise on both sides thereof, and anchoring means in the form of fitting pins 22 are introduced through the passage 18 into the spaces 21 when the insert 7 is fitted in the blade root 2. The pins 22 are secured against moving in the blade root by a suitable means such as by staking or welding and ensure a reliable anchorage of the retaining member 8 and, thus the insert 7, in the blade root 2 and therefore in the jacket 1.

Figure 5:
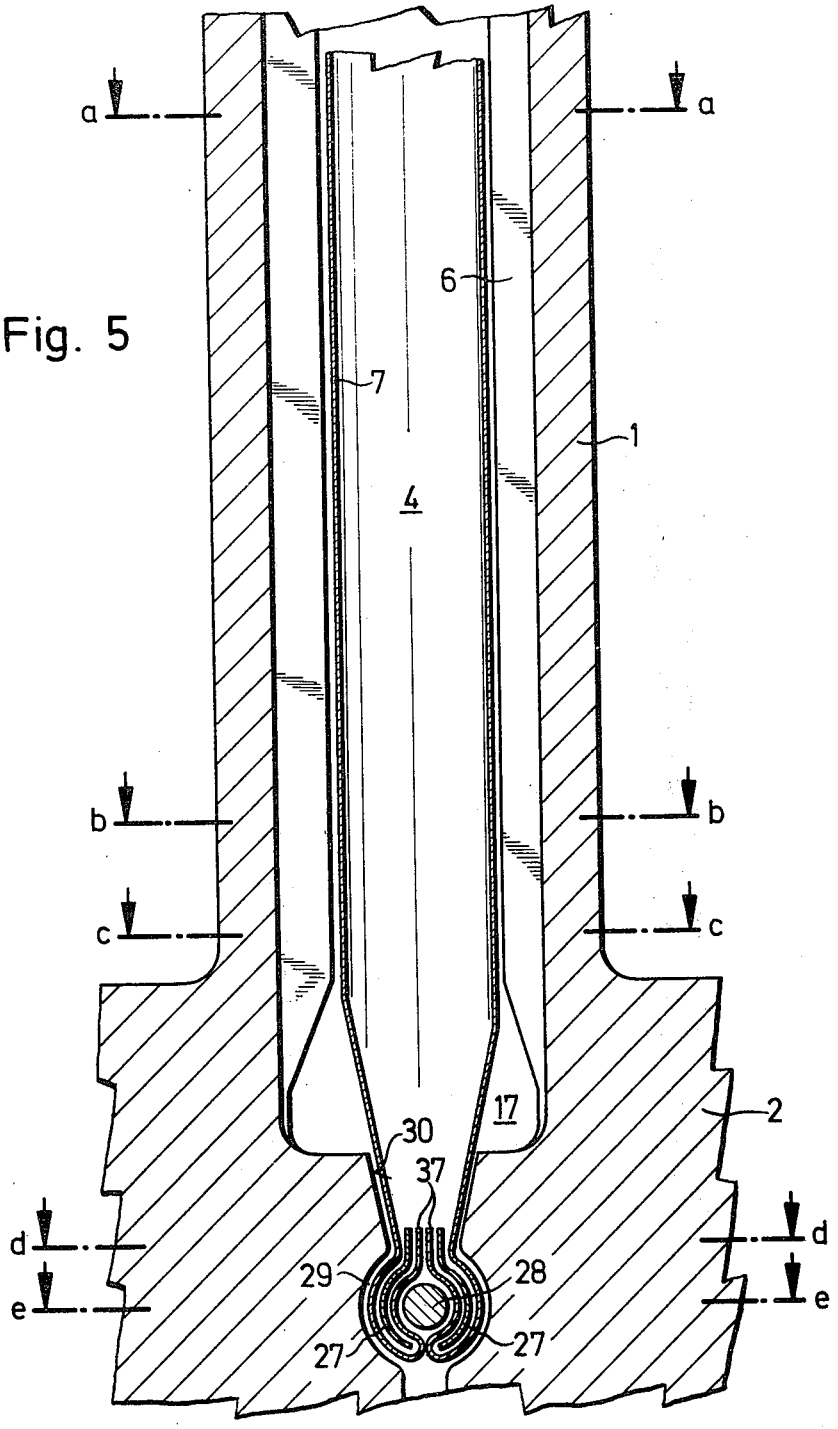
FIG. 5 illustrates a view similar to FIG. 3 of another form of anchoring the insert in the blade root in accordance with the invention.
Figure 6:
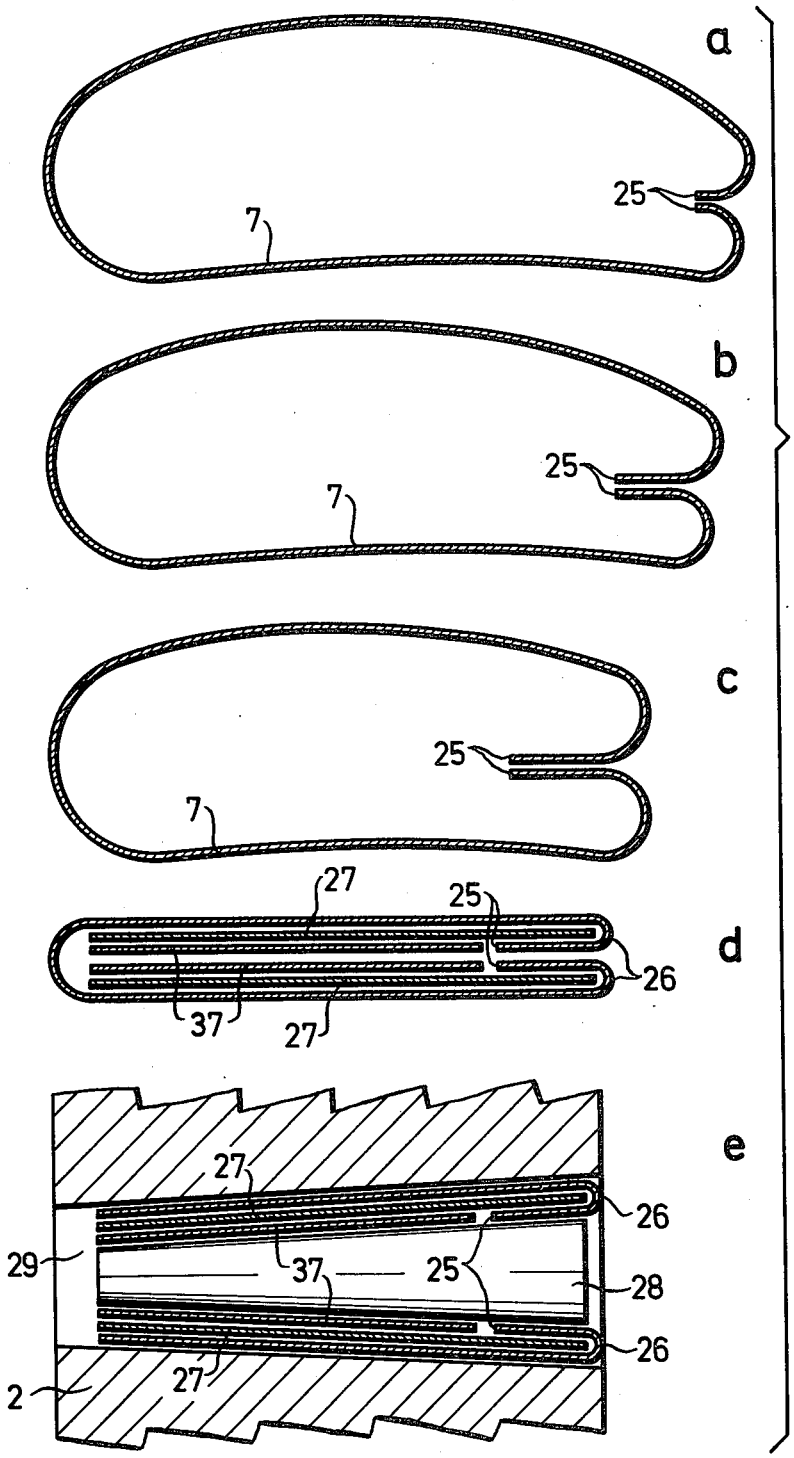
FIG. 6 illustrates a number of sections *a* – *e* through the insert of FIG. 5 in diagrammatic form.

Referring to FIGS. 5 and 6, the insert 7 has the same peripheral length over the whole length of the blade in the hollow chamber 4 which widens continuously from the blade root 2 to the blade tip 3. As FIG. 6 shows, the thin sheet metal insert 7 is shaped in accordance with the shape of the outer jacket inner wall. To this end, the ends 25, i.e. the longitudinally disposed edges of the insert 7 are bent in near the rear edge at the blade, the length of the bent-in portions increasing continuously from the outside towards the inside. To obviate any sharp edging near the bend 26, particularly near or in the blade root 2, a spacer element 27 whose thickness is approximately one and one-half (1½) times the thickness of the insert 7 is introduced between the bent-in portions of each side of the insert 7.

In this embodiment, the insert 7 is anchored in the blade root 2 by means of a pin 28 which has the cross-section of a circular cylinder and which is conical along the length and which is keyed in a matching recess 29 in the blade root 2. The recess 29 communicates by way of a recess 30 which widens outwardly conically with the blade root 2 in order to permit the insert 7 to pass through. To fill up that part of the spaces 29, 30 not filled up by the ends 25 near the blade root 2 and thus to ensure that the pin 28 has a clamping effect over the whole length, the underside of the insert 7 has a stepped portion 37 which is bent up in the blade root 2.

Figure 7:
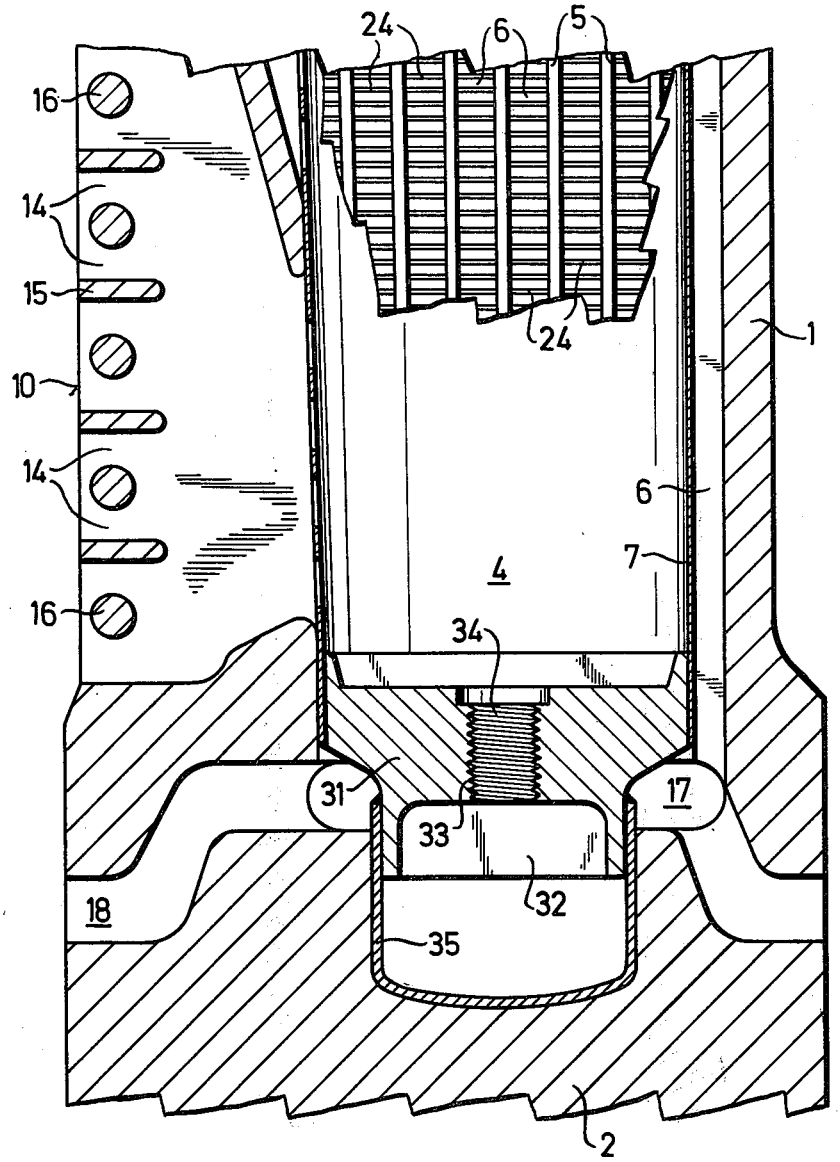
FIG. 7 illustrates a view similar to FIG. 1 of a third form of anchoring the insert in the blade root in accordance with the invention.
Figure 8:
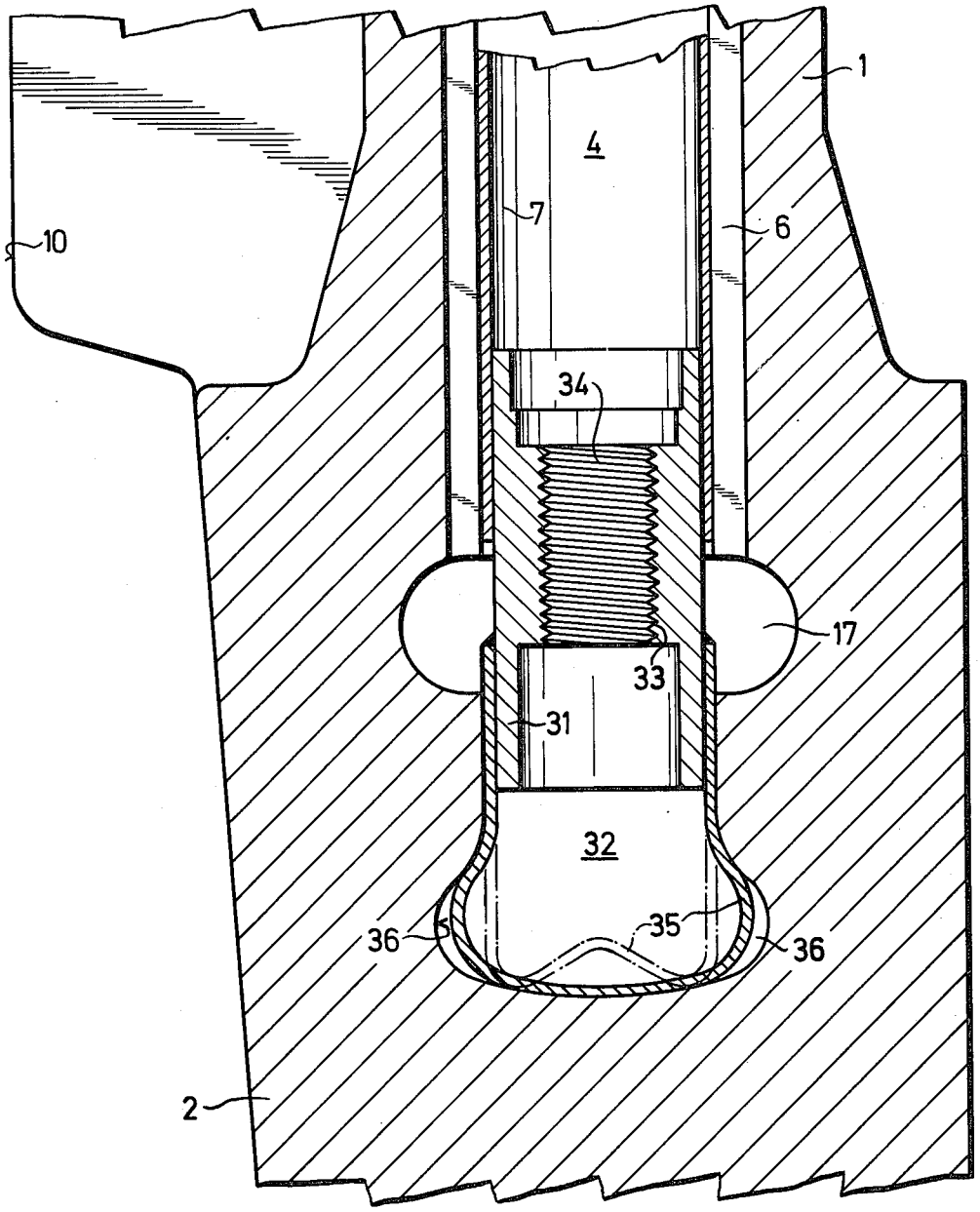
FIG. 8 illustrates a sectional view similar to FIG. 3 of the third form of anchoring the insert in the blade root.

Referring to FIGS. 7 and 8, the insert 7, which again takes the form of a piece of thin resilient sheet metal, is rigidly connected, e.g. by brazing, to a retaining element 31. The underside of this element 31 has a space 32 which communicates, by way of a passage 34 formed with an internal screwthread 33, with the hollow chamber 4 and which is closed at the bottom by a deformable hood-like sheet-metal piece 35. The metal member 35 is initially of the shape shown in chain-dotted lines in FIG. 8 so that the retaining member 31 can be introduced into a bag like recess 36 in the blade root 2. In order to anchor the member 31, the member 35 is widened, in the manner to be described hereinafter, to the shape which is shown in solid lines in FIG. 8 so that the member 35 engages with the inner wall of the widened recess 36.

After the insert 7 has been secured to the retaining member 31, the member 31 is welded to the top edge of the metal member 35. Thereafter, the insert 7 and retaining member 31 are introduced into the recess 36 in the blade root 2, whereafter a tube (not shown) is screwed into the screwthread 33, the tube extending through the length of the blade and possibly being connected via a flexible line to a source (not shown) of hydraulic or pneumatic pressure. In order to seal the space 32, the space around the tube is then filled to a desired height with a relatively low-melting sealant such as a lead-cadmium alloy. Thereafter, the member 35 is deformed hydraulically into a final shape matching the recess 36. After the sealant has been melted out and the tube released, the inner space 32 is filled with brazing powder and heated so that the powder melts and, after cooling, forms a wedge-shaped filling which retains the insert 7 in the blade root 2.

What is claimed is:

1. A cooled rotor blade for a gas turbine comprising a hollow jacket having a perforated partition therein defining a hollow chamber on one side of said partition and having a leading edge, a trailing edge, a blade root and a blade tip;

a plurality of ribs on said jacket within said hollow chamber and extending from said blade root to said blade tip;

at least one insert disposed within said hollow chamber against said ribs to define flow passages therebetween;

a first cooling-air chamber in said blade root in communication with said flow passages;

a second cooling air chamber in said blade tip in communication with said flow passages and with the interior of said insert; and a plurality of air outlets extending over said blade trailing edge and being in communication with said insert interior through orifices in said insert and said perforated partition whereby cooling air passing into said first cooling-air chamber flows through said flow passages, said second cooling-air chamber, said insert interior, said partition and said outlets in said trailing edge.

2. A cooled rotor blade as set forth in claim 1 wherein said hollow chamber has an increasing cross-section from said blade root towards said blade tip and said insert is of thin sheet metal with a constant peripheral length over the length of said blade, said insert having a pair of inwardly bent ends extending longitudinally of the length of said blade, said ends being disposed near said trailing edge.

3. A cooled rotor blade as set forth in claim 2 which further comprises a spacer element adjacent said blade root within each bent end of said insert, each spacer element being of a thickness approximately one and one-half times the thickness of said insert.

4. A cooled rotor blade as set forth in claim 2 which further comprises a recess in said blade root and a wedgeshaped pin means anchoring said insert in said recess.

5. A cooled rotor blade as set forth in claim 1 which further comprises a retaining member secured to said insert at said blade root, a recess in said blade root receiving said retaining member and a pair of pins passing into said retaining member and said blade root to lock said retaining member in said blade root.

6. A cooled rotor blade as set forth in claim 5 which further comprises means for securing said pins against displacement relative to said blade root.

7. A cooled rotor blade as set forth in claim 1 which further comprises a retaining member secured to said insert at said blade root and having a passage therein communicating with the interior of said insert, and a deformable hood-like sheet metal member secured to said retaining member to define a hollow chamber in communication with said passage in said retaining member.

8. A cooled rotor blade as set forth in claim 7 which further comprises a brazable substance partly filling said hollow chamber of said deformable member.

9. A cooled rotor blade as set forth in claim 1 which further comprises a plurality of ribs extending transversely between said ribs on said jacket.

10. A rotor blade for a gas turbine comprising a hollow jacket defining a blade root, a blade tip, a trailing edge and an elongated hollow chamber extending longitudinally between said blade root and said blade tip;

at least one hollow insert within said hollow chamber extending from said blade root to said blade tip;

a first cooling-air chamber in said blade root to receive cooling air;

a second cooling-air chamber in said blade tip in communication with the interior of said insert;

a plurality of flow passages extending from said first cooling-air chamber to said second cooling-air chamber between said insert and said jacket;

a plurality of orifices in said insert communicating with said trailing edge to exhaust air from within said insert through said trailing edge.

11. A rotor blade as set forth in claim 10 which further comprises means within said blade root for anchoring said insert within said hollow chamber.

* * * * *